US010392730B2

(12) United States Patent
Bruynoghe et al.

(10) Patent No.: US 10,392,730 B2
(45) Date of Patent: Aug. 27, 2019

(54) CLAMPING OF THE POSITION OF THE LATITUDINAL PARTS OF A FABRIC GUIDING DEVICE

(71) Applicant: NV MICHEL VAN DE WIELE, Kortrijk/Marke (BE)

(72) Inventors: Koen Bruynoghe, De Pinte (BE); Sander Goethals, Balegem (BE)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 148 days.

(21) Appl. No.: 15/557,767

(22) PCT Filed: Mar. 10, 2016

(86) PCT No.: PCT/IB2016/051370

§ 371 (c)(1),
(2) Date: Sep. 12, 2017

(87) PCT Pub. No.: WO2016/142900

PCT Pub. Date: Sep. 15, 2016

(65) Prior Publication Data

US 2018/0073170 A1 Mar. 15, 2018

(30) Foreign Application Priority Data

Mar. 12, 2015 (BE) ..... 2015/5136

(51) Int. Cl.
*D03D 49/20* (2006.01)
*D03D 39/18* (2006.01)
(Continued)

(52) U.S. Cl.
CPC ..... *D03D 39/18* (2013.01); *D03D 49/02* (2013.01); *D03D 49/22* (2013.01)

(58) Field of Classification Search
CPC ..... D03D 49/22; D03D 49/20; D03D 39/18; D03D 3/005; D03D 3/02; D03D 41/00; D03D 49/02
See application file for complete search history.

(56) References Cited

U.S. PATENT DOCUMENTS 2,639,483 A * 5/1953 Wester ..... B65H 23/0208 226/15
3,414,954 A * 12/1968 Alexeff ..... B65H 23/0208 226/17

(Continued)

FOREIGN PATENT DOCUMENTS

EP 0 316 575 A1 5/1989
EP 1 471 174 A2 10/2004

OTHER PUBLICATIONS

International Search Report and Written Opinion dated Jul. 21, 2016.

*Primary Examiner* — Robert H Muromoto, Jr.
(74) *Attorney, Agent, or Firm* — Symbus Law Group, LLC; Clifford D. Hyra

(57) ABSTRACT

A fabric guiding device (1) for a weaving machine, having automatic clampers (6), (7) to release or secure a bridge, for example an upper bridge (2) and/or a lower bridge (3). On the other hand, a method for releasing and re-clamping a bridge of a fabric guiding device of a weaving machine. Preferably suitable for use in a weaving machine. More particularly, for use in a face-to-face weaving machine.

14 Claims, 3 Drawing Sheets

(51) Int. Cl.

| | |
|---|---|
| ***D03D 49/02*** | (2006.01) |
| ***D03D 49/22*** | (2006.01) |
| *D03D 49/12* | (2006.01) |

(56) References Cited

U.S. PATENT DOCUMENTS 3,822,448 A * 7/1974 Cho ..... D06C 3/062 26/75
3,943,979 A * 3/1976 Porter ..... D03J 1/223 139/296
4,097,973 A * 7/1978 Cho ..... D06C 3/06 26/78
4,322,802 A * 3/1982 Lewis, Jr. ..... B41F 33/00 26/98
4,381,587 A * 5/1983 Cho ..... B65H 23/0204 226/17
4,519,595 A * 5/1985 Adachi ..... B65H 16/106 270/30.11
4,652,736 A * 3/1987 Osterberg ..... D21F 9/00 250/559.29
4,760,626 A * 8/1988 Lonner ..... B65H 23/025 226/20
4,778,438 A * 10/1988 Tastavin ..... D05B 41/00 112/470.36
6,431,220 B1 * 8/2002 Nakada ..... D03D 49/20 139/311
6,959,566 B2 * 11/2005 Zorini ..... D04B 25/12 66/204
7,171,283 B2 * 1/2007 Popp ..... G05B 19/042 700/121
7,284,305 B1 * 10/2007 Allen ..... B23K 26/0846 26/7
7,475,570 B2 * 1/2009 Zorini ..... D04B 27/22 66/210
2002/0059962 A1 * 5/2002 Nakada ..... D03D 49/20 139/311
2002/0139470 A1 * 10/2002 Robitaille ..... B31F 1/2886 156/205
2004/0028268 A1 * 2/2004 Popp ..... G06T 7/70 382/141
2004/0133297 A1 * 7/2004 Vergote ..... D03D 51/18 700/140
2005/0066693 A1 * 3/2005 Zorini ..... D04B 25/12 66/81
2005/0279462 A1 * 12/2005 Robitaille ..... B31F 1/2886 156/539
2006/0169003 A1 * 8/2006 Zorini ..... D04B 27/22 66/85 R
2012/0018029 A1 * 1/2012 Shen ..... D03C 9/024 139/35
2014/0238081 A1 * 8/2014 Meir ..... D04B 1/22 66/64
2018/0002133 A1 * 1/2018 Stewart ..... D04B 15/44
2018/0073170 A1 * 3/2018 Bruynoghe ..... D03D 39/18
2019/0032256 A1 * 1/2019 Zhou ..... D01G 25/00

* cited by examiner

CLAMPING OF THE POSITION OF THE LATITUDINAL PARTS OF A FABRIC GUIDING DEVICE

This application claims the benefit of Belgian patent application No. BE2015/5136, filed Mar. 12, 2015, which is hereby incorporated by reference in its entirety.

FIELD OF THE DISCLOSURE

The present disclosure relates, on the one hand, to a fabric guiding device for a weaving machine, comprising automatic clamping means to release or secure a bridge, for example an upper bridge and/or a lower bridge. On the other hand, the present disclosure relates to a method for releasing and re-clamping a bridge of a fabric guiding device for a weaving machine. The device is preferably suitable for use in a weaving machine. More particularly, the device is suitable for use in a face-to-face weaving machine.

The present disclosure further relates to a weaving machine provided with a fabric guiding device according to the disclosure.

BACKGROUND

In this patent application, the terms bridge, upper bridge and lower bridge are used to refer to the cross beams which are secured above and/or underneath the fabric over the weaving width of the machine and which serve to guide the fabrics in the direction of the place where the fabrics are rolled up onto rolls or folded in carts, away from the weaving reed.

In face-to-face weaving machines, two fabrics are woven simultaneously, usually one above the other, each of which comprises a base fabric consisting of weft yarns and warp yarns. In the case of weaving fabrics with cut pile, these base fabrics are connected to one another with the aid of pile warp yarns which move from the bottom base fabric to the top base fabric and vice versa in a pattern-forming manner.

During the weaving process, the two fabrics (which together form the non-separated face-to-face fabric) are then moved together through the opening formed between the upper bridge and the lower bridge. In this patent application, the space between the upper bridge and the lower bridge is referred to as the jaw. These two fabrics in the non-separated face-to-face fabric are kept apart over a distance which substantially corresponds to the distance between upper bridge and lower bridge (the jaw height). In some cases, use is additionally made of a lancet device comprising elongate metal strips (the lancets). A plurality of lancets extends in the warp direction over the width of the weaving machine into the jaw, between the lower and upper base fabric. The non-separated face-to-face fabric is then supplied to the cutting device which will use a cutting knife to perform a cutting operation, thus forming two fabrics with cut pile.

In single-face weaving machines, one single fabric consisting of weft yarns, warp yarns and pile warp yarns is woven. This fabric is guided along an upper bridge and/or a lower bridge. The position of the upper bridge (and thus the jaw height) can be readjusted on changing the fabric thickness.

The adjustment of this jaw is a delicate process involving:

setting a specific, exact value of the jaw height;

keeping the jaw height equal on the left and the right of the weaving machine;

in the case of a face-to-face weaving machine having a cutting device, keeping the cutting device in the correct position with respect to the jaw;

preventing or at least limiting the bending of the upper bridge and the lower bridge in order to minimize an uneven pile height over the width of the weaving machine.

Belgian patent BE 1000995 describes a device which simplifies the adjustment of the jaw and which makes it no longer necessary to apply the 'trial and error' method in which the result of each adjustment of the jaw has to be assessed by weaving a piece of fabric. To this end, the cutting device is firstly provided with one or more electronic position sensors emitting a signal which is respectively in relation to the position of the upper bridge and the lower bridge with respect to the cutting knife. Secondly, the upper bridge and the lower bridge are each provided with adjusting spindles at their ends, which can optionally be driven by an electric motor in order to facilitate the adjustment of the upper bridge and the lower bridge. By readjusting the different adjusting spindles, it is possible to read and check the distances, on the one hand, between the upper bridge and the lower bridge and, on the other hand, between one of the bridges and a reference point on the weaving machine (upper or lower side of the cutting knife) or to use the processor unit to actuate the drive in order to thus reach the desired position.

However, the device described in BE 1000995 does not offer a simple and rapid solution for releasing the bridges before they are positioned and for re-securing these bridges once the desired position has been reached. Releasing and securing the bridges is a time-consuming process and is also ergonomically burdensome. The standard solution for securing a bridge is to fix it in various locations against the chassis of the weaving machine using bolts.

SUMMARY

An object of some embodiments of the present invention is therefore to provide a simplified fabric guiding device for a weaving machine, by means of which the bridge(s) can be released automatically before adjusting the position of the upper bridge and/or the lower bridge and by means of which the bridge(s) can be re-secured automatically after this adjustment.

The object may be achieved by providing a fabric guiding device for a weaving machine, comprising an upper bridge and/or a lower bridge, wherein the device comprises first automatic clamping means which are provided in order to release and secure the upper bridge and/or the lower bridge. Preferably, the fabric guiding device as disclosed comprises at least a lower bridge and the device further comprises second automatic clamping means which are provided in order to release and secure the lower bridge between its two ends. The second automatic clamping means are particularly suitable as means for compensating for the bending. This bending is the result of the own weight of the bridge and/or of the forces exerted by the fabric on the bridge resulting from the yarn tension.

The automatic first and/or second clamping means comprise, for example, pneumatic, hydraulic or electric actuators. The position of the bridge can be secured using the automatic clamping means. The clamping means used in the fabric guiding device according to the invention preferably have a defined operative state when they are de-energized, either of the 'normally open' type or the 'normally closed' type. In order to bring about the clamping, the clamping means preferably comprise spring elements which are energized or de-energized in order to bring about or cancel the clamping.

In a preferred embodiment of the fabric guiding device according to the invention, the first and/or second automatic clamping means are provided in order to connect the bridge on which they act to the chassis of the weaving machine.

In an embodiment of the fabric guiding device according to the invention for weaving machines (such as single-face weaving machines, for example) in which it is only possible to adjust the position of one bridge, only this bridge is provided with first automatic clamping means. In an embodiment according to the invention for weaving machines in which only the position of the lower bridge can be adjusted, this bridge is provided with first automatic clamping means and preferably also with second automatic clamping means between the two ends of this bridge.

In an embodiment of the fabric guiding device according to the invention for weaving machines in which it is possible to adjust the position of both bridges, both bridges are provided with first automatic clamping means. In a more preferred embodiment, the fabric guiding device also comprises second automatic clamping means in order to secure the lower bridge between its two ends.

In accordance with a particular embodiment of the device according to the invention, the device comprises drive means provided in order to position the upper bridge and/or the lower bridge.

In a particular embodiment of the fabric guiding device according to the invention for a weaving machine having one or two positionable bridges, the positionable bridges are provided with drive means.

In a more preferred embodiment of the fabric guiding device according to the invention for a weaving machine having two positionable bridges, only one of the bridges is directly provided with drive means and the fabric guiding device comprises an upper and lower bridge and the device further comprises coupling means which are switchable between a first position in which the upper bridge and the lower bridge are coupled to one another, as a result of which the upper bridge and the lower bridge are positionable together with the aid of said drive means, and a second position in which the upper bridge and the lower bridge are decoupled from one another so that only the upper bridge or only the lower bridge is positionable with the aid of the drive means.

Only directly providing one of the two bridges with drive means and using a coupling means which enables the user to either move only the bridge on which the drive means act directly or to move both bridges simultaneously has the advantage that the device is less complex with respect to what is known from the prior art, but that it nevertheless allows the mutual position of the upper bridge and the lower bridge (jaw height), on the one hand, and their position with respect to a fixed reference point in the weaving machine, such as the cutting position, for example, in the case of face-to-face weaving machines having a cutting device, on the other hand, to be accurately adjusted. The cutting position can be defined as the line of the successive positions of the point of the cutting knife during the cutting operation. The movement of a point on the upper or lower surface of the cutting knife can be selected as a good approximation of the cutting position, with half of the thickness of the cutting knife also being taken into account in order to approximate the actual cutting position as accurately as possible.

This application refers to jaw height since the known devices for weaving machines conduct the positioning of the bridges in a vertical plane. When positioning the bridges in a non-vertical plane, it will be clear that the term jaw height means the perpendicular distance between the upper bridge and the lower bridge.

With the coupling means, it is possible to (temporarily) lock the distance between the upper bridge and the lower bridge. The coupling means used in the fabric guiding device as disclosed preferably has a defined operative state when it is de-energized, either of the 'normally open' type or the 'normally closed' type. In order to bring about the coupling, the coupling means preferably comprises spring elements which are energized or de-energized in order to bring about or cancel the coupling.

In a particular embodiment of the fabric guiding device according to the invention, the drive means comprise a first and second drive means, wherein the first drive means is provided at one end of the bridge which is positionable when the coupling means are switched into their second position and wherein the second drive means is provided at the other end of said bridge. The drive means may also comprise a third drive means which is provided in the middle of the lower bridge.

In practice, it is easier to place the drive means when they are provided on the lower bridge, as a result of which this lower bridge is directly drivable. In a preferred embodiment of the device according to the invention, the lower bridge is thus positionable in both the first and the second position of the coupling means, and said coupling means are switchable between a first position in which the lower bridge and the upper bridge are coupled to one another, as a result of which they are positionable together, and a second position in which only the lower bridge is positionable.

According to a preferred embodiment of the fabric guiding device according to the invention, the drive means are manually operable. According to an even more preferred embodiment of the fabric guiding device according to the invention, the drive means comprise hydraulic or electric actuators.

In a particular embodiment of the device according to the invention, the drive means comprise one or more screw means which are provided in order to position the upper bridge or the lower bridge with respect to one another or with respect to a fixed reference point in the weaving machine. These screw means can be operated manually or automatically. In a more preferred embodiment of the fabric guiding device, the drive means comprise at least one electric motor which is provided in order to rotate the screw means for adjusting the bridges. An example of a drive means according to the invention is a motor/spindle combination, optionally provided with a gear unit.

In a more particular embodiment of the device according to the invention, the fabric guiding device comprises an upper bridge and a lower bridge and the device further comprises one or more position sensors for determining the position of the upper bridge, the lower bridge and the reference point. After calibration, for example with the aid of a first selected jaw adjustment with manual measurement of the distance of the lower bridge and the upper bridge from one another and with respect to the reference point, the position sensors are suitable for determining the relative positions of the upper bridge, the lower bridge and the reference point with respect to one another.

Preferably, the position sensors are at least provided at both ends of both the lower bridge and the upper bridge. Furthermore, in a preferred embodiment, it is also possible to provide position sensors at both ends at the height of the cutting position in face-to-face weaving machines having a cutting device. In a more preferred embodiment, one or more position sensors are likewise also provided at (or in the vicinity of) the middle of one of the bridges, for example the lower bridge. This (these) position sensor(s) is (are) particularly suitable for detecting the position of the bridge at the middle, in order to thus check whether or not the bridge has undergone bending. The position sensors used in the device are preferably of the following types: contact-based or contactless, such as optical (laser) or inductive, for example.

The present disclosure also relates to a weaving machine provided with a fabric guiding device, as described above. The weaving machine or the fabric guiding device can further be provided with means for inputting the desired jaw height and for displaying the positions measured by the position sensors.

Another subject of the present disclosure relates to a method for positioning a lower bridge and/or an upper bridge of a fabric guiding device of a weaving machine, wherein the fabric guiding device comprises first automatic clamping means which are provided in order to clamp the ends of the upper bridge and/or the lower bridge, wherein, before positioning the lower bridge and/or the upper bridge, the clamping means clamping the lower bridge and/or the upper bridge, respectively, are released and, when the desired position has been reached, the first clamping means re-clamp the ends of the upper bridge and/or the lower bridge in order to hold these in the desired position.

The method is provided, in particular, for positioning a lower bridge of a fabric guiding device of a weaving machine, having at least a lower bridge, wherein the fabric guiding device comprises first automatic clamping means which are provided in order to clamp the ends of the lower bridge, and comprises second automatic clamping means which are provided in order to clamp the lower bridge between its two ends, wherein, before the ends of the lower bridge are clamped with the first clamping means:

a. the first and second clamping means are released,
b. said lower bridge is moved until the desired position between the two ends is reached,
c. after which the second clamping means clamp the lower bridge between its two ends,
d. after which the two ends of the lower bridge are then positioned further.

The disclosed method is particularly suitable for being applied to the fabric guiding device described in this application. More particularly, the method is suitable for being applied to a fabric guiding device for a face-to-face weaving machine comprising: a cutting device, a coupling means, first and second drive means, position sensors, a lancet device, etc.

For a preferred embodiment of the fabric guiding device according to the invention, where only the lower bridge is positionable with the coupling means switched in their second position, a further preferred method comprises at least one of the following preparatory steps in a desired change of relative position of the lower bridge and the upper bridge with respect to one another or with respect to a cutting knife:

- Determining the current positions of the upper bridge, the lower bridge and the cutting knife, from which the jaw height, the bending of the lower bridge (if the position in the middle of the lower bridge is measurable) and the relative position of the cutting line of the cutting knife with respect to the jaw opening are derivable, wherein position sensors are provided at least at each of the ends of the upper bridge and the lower bridge;
- Determining the desired new jaw height and/or the desired relative position of the cutting line of the cutting knife with respect to the jaw opening;
- Converting these values into the desired new positions for the upper bridge and the lower bridge;
- Preparing the weaving machine:
  - In the case of a desired reduction of the jaw height, if necessary, reducing the height of the lancets in the jaw opening as a function of the desired new jaw height;
  - Reducing the size and/or the direction of the force of the fabric acting on the lower bridge and the upper bridge by, where possible, lowering the yarn tension and/or moving the weaving frames into an adjusted position;
  - Checking and optionally activating the process of energizing the position-adjusting drive means to a level which allows the existing positions to be maintained when the clamping means are released.

In order to set a desired position for the upper bridge and/or the lower bridge, the method may comprise at least one of the following steps:

- If necessary, setting the desired position of the upper bridge:
  - Switching the coupling means into the coupled state;
  - Releasing the first clamping means at the ends of the upper bridge and the lower bridge and, if present, the second clamping means in the middle of the lower bridge;
  - Moving the upper bridge into the desired position with the aid of the position-adjusting drive means of the lower bridge;
  - Securing the first clamping means at the ends of the upper bridge;
- Setting the desired position of the lower bridge:
  - Moving the coupling means into the uncoupled position;
  - If this has not yet happened, releasing the first clamping means at the ends of the lower bridge and, if present, the second clamping means in the middle of the lower bridge;
  - If there are only position-adjusting drive means at the ends of the lower bridge, but if one or more position sensors are present in the middle of the lower bridge:
    - Moving the lower bridge until the desired position in the middle of the lower bridge has been reached;
    - Securing the second clamping means in the middle of the lower bridge;
    - Moving the lower bridge until the desired position at the ends of the lower bridge has been reached;
    - Securing the first clamping means at the ends of the lower bridge.
  - If, in addition to the position-adjusting drive means at the ends of the lower bridge, at least one position-adjusting drive means, in the form of a third drive means, and one or more position sensors are present in the middle of the lower bridge:
    - Moving the lower bridge, with both the position-adjusting drive means at the ends of the lower bridge and those in the middle of the lower bridge, until the desired position at the ends of the lower bridge has been reached;
    - Securing the first clamping means at the ends of the lower bridge;

Moving the middle of the lower bridge with the position-adjusting drive means in the middle of the lower bridge until the desired position has been reached;

Securing the second clamping means in the middle of the lower bridge.

If no position-adjusting drive means and no position sensor is present in the middle of the lower bridge:

Moving the lower bridge until the desired position at the ends of the lower bridge has been reached;

Securing the first clamping means at the ends of the lower bridge and the second clamping means in the middle of the lower bridge, if these are present.

The method may further comprise at least one of the steps described below in order to re-prepare the weaving machine for weaving:

Deactivating the process of energizing the position-adjusting drive means and the coupling means;

Bringing the yarn tension on the lower bridge and the upper bridge to a normal level required for fabric production and/or re-normalizing the position of the weaving frames;

If the jaw height has been increased, if necessary, adapting the height of the lancets in the jaw opening as a function of the jaw height which has just been set.

Obviously, an analogue method, with an embodiment of the fabric guiding device according to the invention in which only the upper bridge is positionable with the coupling means switched into their second position, also forms part of the present disclosure. This analogue method comprises at least one of the same preparatory steps as in the case of a desired change of relative position of the lower bridge and the upper bridge with respect to one another or with respect to a cutting knife and at least one of the same steps in order to re-prepare the weaving machine for weaving, as described above for the embodiment in which only the lower bridge is positionable with the coupling means switched into their second position.

For setting a desired position for the upper bridge and/or the lower bridge, said analogue method comprises at least one of the following steps:

If necessary, setting the desired position of the lower bridge:

Switching the coupling means into the coupled position;

Releasing the first clamping means at the ends of the upper bridge and the lower bridge and, if present, the second clamping means in the middle of the lower bridge;

If there are only position-adjusting drive means at the ends of the upper bridge, but if one or more position sensors are present in the middle of the lower bridge:

Moving the lower bridge with the aid of the position-adjusting drive means of the upper bridge until the desired position in the middle of the lower bridge has been reached;

Securing the second clamping means in the middle of the lower bridge;

Moving the lower bridge with the aid of the position-adjusting drive means of the upper bridge until the desired position at the ends of the lower bridge has been reached;

Securing the first clamping means at the ends of the lower bridge;

If, in addition to the position-adjusting drive means at the ends of the upper bridge, at least one position-adjusting drive means, in the form of a third drive means, and one or more position sensors are present in the middle of the lower bridge:

Moving the lower bridge, using both the position-adjusting drive means at the ends of the upper bridge and those in the middle of the lower bridge, until the desired position at the ends of the lower bridge has been reached;

Securing the first clamping means at the ends of the lower bridge;

Moving the middle of the lower bridge using the position-adjusting drive means in the middle of the lower bridge until the desired position has been reached;

Securing the second clamping means in the middle of the lower bridge;

If no position-adjusting drive means or position sensor is present in the middle of the lower bridge:

Moving the lower bridge with the aid of the position-adjusting drive means of the upper bridge until the desired position at the ends of the lower bridge has been reached;

Securing the first clamping means at the ends of the lower bridge and the second clamping means in the middle of the lower bridge, if these are present;

Setting the desired position of the upper bridge:

Bringing the coupling means into the uncoupled position;

If this has not yet happened, releasing the first clamping means at the ends of the upper bridge;

Moving the upper bridge until the desired position at the ends of the upper bridge has been reached;

Securing the first clamping means at the ends of the upper bridge.

A method with an embodiment of a fabric guiding device according to the invention without coupling means and with an upper bridge and/or a lower bridge which is directly positionable using drive means also forms part of the present disclosure. This method comprises at least one of the same preparatory steps as in the case of a desired change of relative position of the lower bridge and the upper bridge with respect to one another or with respect to a cutting knife and at least one of the same steps in order to re-prepare the weaving machine for weaving, as described above for the embodiment in which only the lower bridge is positionable with the coupling means switched into their second position.

The positioning of the lower bridge and/or the upper bridge can take place independently of one another and in any desired order.

In order to position the lower bridge, this method comprises at least one of the same steps as in the part of the method described above for positioning the lower bridge for the embodiment in which only the lower bridge is positionable with the coupling means switched into their second position, wherein the steps referring to the coupling means do not have to be carried out. In order to position the upper bridge, this method comprises at least one of the same steps as in the part of the method described above for positioning the upper bridge for the embodiment in which only the upper bridge is positionable with the coupling means switched into their second position, wherein the steps referring to the coupling means do not have to be carried out.

BRIEF DESCRIPTION OF THE DRAWINGS

In order to further explain the properties of the present invention and to indicate additional advantages and particulars thereof, a more detailed description of a fabric guiding device according to the present invention now follows. It will be clear that nothing in the following description can be interpreted as a limitation of the scope of protection of the present invention defined in the claims.

In this description, reference numerals are used to refer to the attached drawings, in which.

DETAILED DESCRIPTION

Figure 1:
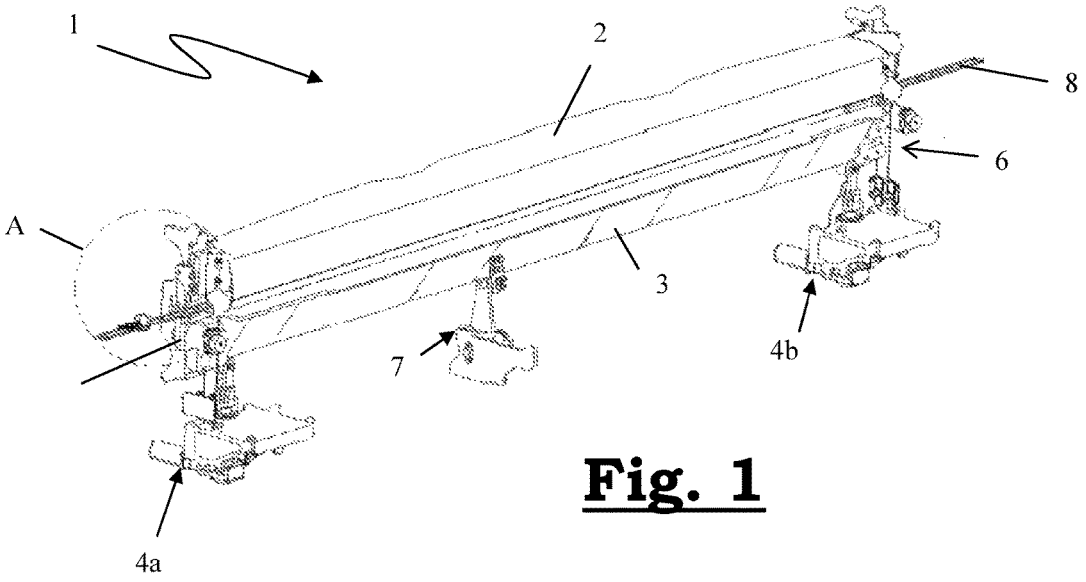
FIG. 1 shows a perspective view of an embodiment of a fabric guiding device according to the invention with the lower bridge and the upper bridge in the coupled position.
Figure 2:
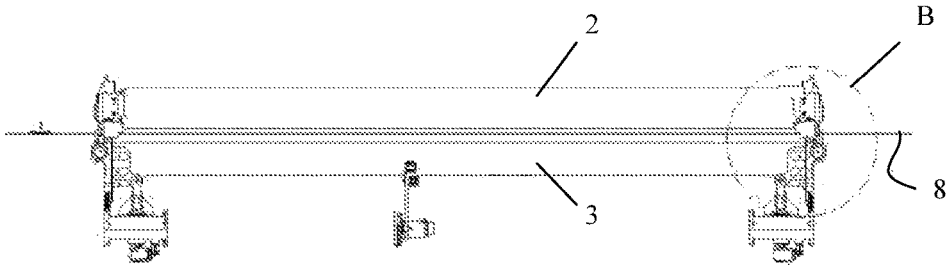
FIG. 2 shows a front view of the device illustrated in FIG. 1.
Figure 3:
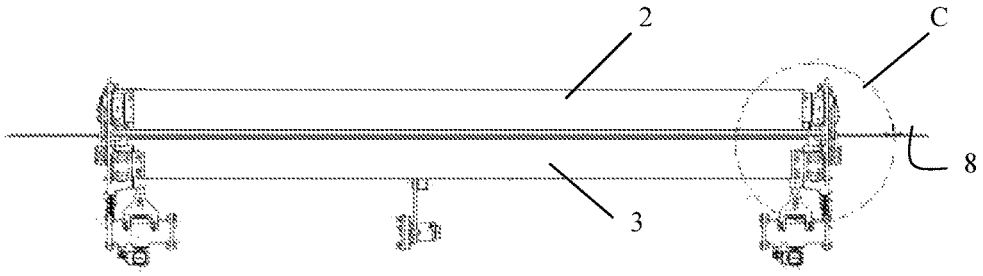
FIG. 3 shows a rear view of the device illustrated in FIG. 1.
Figure 4:
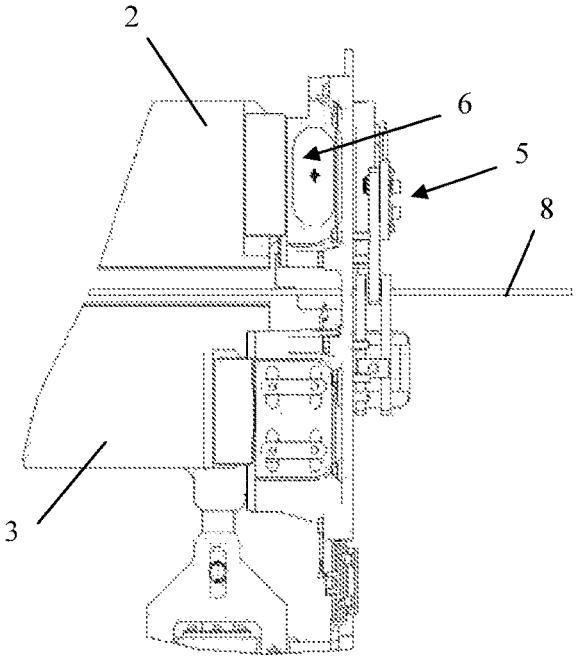
FIG. 4 shows a detail view of the area B encircled in FIG. 2.
Figure 5:
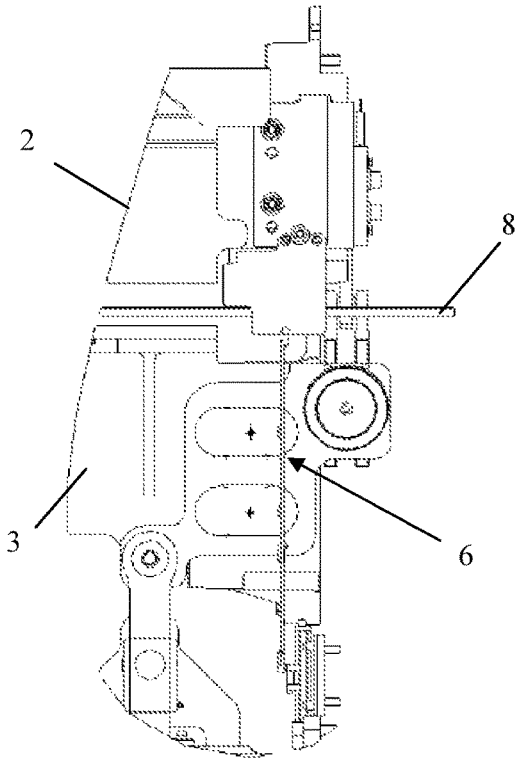
FIG. 5 shows a detail view of the area C encircled in FIG. 3.
Figure 6:
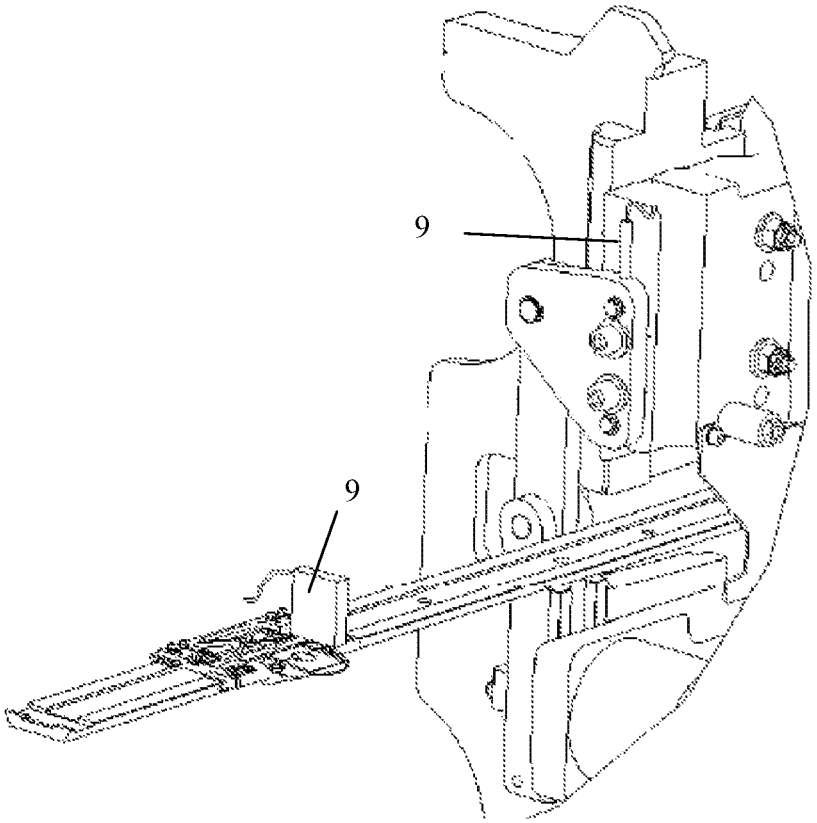
FIG. 6 shows a detail view of the area A encircled in FIG. 1.

An embodiment of the present invention is a fabric guiding device (1) for a face-to-face weaving machine, illustrated in FIGS. 1 to 3. This comprises a cutting knife (8) and an upper bridge (2) and a lower bridge (3) which are positionable with the aid of drive means (4*a;* 4*b*) at an adjustable distance from one another and from the cutting knife. The cutting knife is movable on a guide which is securely connected to the machine frame.

The drive means (4*a;* 4*b*) comprise a first (4*a*) and second (4*b*) drive means. The drive can be realized manually (adjustable screw spindle), electrically (screw spindle+servomotor+gear unit) or hydraulically (hydraulic servo cylinders). In the illustrated device (1), the drive means (4*a;* 4*b*) are mechanically connected to the ends of the lower bridge (3). The system which guarantees the vertical movement of the lower bridge mainly comprises a mounted screw spindle and a servomotor with a gear unit. The upper bridge (2) does not have its own drive for its positioning. In order to move (position) the upper bridge (2), it can be mechanically connected to the lower bridge (3), in which case both move together. In order to realize the mechanical connection (coupling) between the lower bridge (3) and the upper bridge (2), the device (1) comprises coupling means (5) which are switchable between a first position in which the upper bridge (2) and the lower bridge (3) are coupled to one another, as a result of which the upper bridge (2) and the lower bridge (3) are positionable together with the aid of said drive means (4*a*; 4*b*), and a second position in which the upper bridge (2) and the lower bridge (3) are decoupled from one another so that only the lower bridge (3) is positionable with the aid of the drive means (4*a;* 4*b*).

The mechanical connection between the lower bridge (3) and the upper bridge (2) can be engaged or disengaged at any position. The mechanical connection is achieved by an adjustable mechanical locking element or with the aid of a connection based on friction (clamping based on hydraulic machine clamps), optionally combined with said adjustable mechanical locking element. The mechanical locking element can be actuated electrically, hydraulically or pneumatically. For instance, it is possible to first bring the upper bridge (2) into position in order to then disengage the mechanical connection and subsequently to bring the lower bridge (3) into position. Once the set position has been reached, the lower bridge (3) and the upper bridge (2) are secured in this position. To this end, the device (1) is provided with first automatic clamping means (6).

In order to limit bending of the lower bridge (3) under load (during weaving) and thus to achieve a good and constant product quality, the middle of the lower bridge (3) must be supported. To this end, the device (1) comprises second automatic clamping means (7) which are provided in order to secure the lower bridge (3) between its two ends when the desired position has been reached. The actuators which actuate the automatic clamping means may be of a pneumatic, hydraulic or electric type.

This support provided by the second automatic clamping means (7) is passive. In the context of the invention, passive support is understood to mean that a certain middle position can be guaranteed, but that the support itself cannot change this position. The following text contains an explanation of this passive support.

In order to keep the bending of the lower bridge (3) under control, the desired positions of the ends of the lower bridge (3) will also be used as the basis for a desired middle position. The desired middle position will always be in relation to the position of the ends of the lower bridge (3).

The middle support is activated when the desired middle position has been reached. The desired middle position of the lower bridge is realized by moving the entire lower bridge upwards/downwards until the desired middle position has been reached. At that point, the middle support is activated and this middle position is thus secured.

The system of passive support described above can be expanded, as explained below, to include an 'active' component. 'Active' is used to refer to the fact that the support can not only secure the middle position but that this system is also able to change this position itself independently of the ends of the lower bridge. This expansion does require an additional (third) drive means which is positioned in the vicinity of the middle and which is able to compensate for the bending of the lower bridge in a simple manner.

When the desired position of the lower bridge (3) and/or the upper bridge (2) is reached, the position is secured by clamping both ends of the bridges against the supports via the first clamping means (6). This removes any degree of freedom. These supports are mounted against the chassis of the machine. The connection is based to a significant extent on friction. The clamping is effected by means of machine clamps which can be automatically engaged and disengaged. The machine clamps operate on the basis of hydraulic pressure or on the basis of a mechanical spring which can be hydraulically disengaged.

The machine clamps move together with the bridges, which is possible owing to the fact that grooves are present in the supports and because the clamps can assume different positions on the bridges.

The bridges are clamped during the operation of the machine; the clamps are only released in order to carry out positioning.

The load on the system for positioning can be reduced by reducing the tension on the yarns during the positioning of the upper bridge and/or the lower bridge and/or by adjusting the angle of the yarn with the horizontal plane. Prior to the positioning, the machine control unit will lower the yarn tension on the lower bridge and the upper bridge and/or adjust the position of the weaving frames. After the positioning, these changes will be reversed.

The fabric guiding device (1) according to the present invention can also be provided with position sensors (9) arranged at both ends of the device, either to measure the distance of both the upper bridge (2) and the lower bridge (3)

from the cutting knife (8) or to measure the mutual distance between the upper bridge (2) and the lower bridge (3), or both. These measurement signals recorded by the position sensors (9) can be displayed within the visual field of the user (operator). During the adjustment of the bridges, he can simply read off what the new jaw height is (in the case of measurement of the distance between the upper bridge (2) and the lower bridge (3)) or what the new distance is between the upper bridge (2) and the cutting knife (8) and/or between the lower bridge (3) and the cutting knife (8) (in a good setting, both of these distances should be substantially identical). In this way, the user immediately sees the effect of his adjustment and can terminate it once he has reached the desired jaw height and thus the desired pile height resulting therefrom. The position sensors used are, for example, contactless sensors such as those based on laser beams, for example.

A processor unit can also be used in order to move the upper bridge (2) and/or the lower bridge (3) over a specified distance via the drive means in combination with the signals from the position sensors. In this case, the first (4*a*) and the second (4*b*) drive means are preferably actuated synchronously.

Furthermore, the fabric guiding device (1) can also be provided with one or more position sensors in the middle of the lower bridge. With the display of the measurement signals from this (these) position sensor(s) in combination with the desired middle position of the lower bridge, the user can minimize the bending of the lower bridge during the positioning of the lower bridge. If there are no position sensors in the middle of the lower bridge, the user can provide the processor unit with a (manual) measurement value for the bending of the lower bridge, so that it is still possible to take into account the bending during the movement of the lower bridge and thus minimize the bending to the greatest possible extent.

The invention claimed is:

1. Fabric guiding device for a weaving machine, comprising an upper bridge and/or a lower bridge, wherein the device comprises first automatic clampers which are provided in order to release and secure the upper bridge and/or the lower bridge.

2. Fabric guiding device according to claim 1, characterized in that the device comprises at least a lower bridge and in that the device further comprises second automatic clampers which are provided in order to release and secure the lower bridge between its two ends.

3. Fabric guiding device according to claim 1, characterized in that the first and/or second clampers comprise hydraulic or electric actuators.

4. Fabric guiding device according to claim 1, characterized in that the first and/or second clampers are provided in order to connect the upper bridge or the lower bridge to the chassis of the weaving machine.

5. Fabric guiding device according to claim 1, characterized in that the device comprises a drive provided in order to position the upper bridge and/or the lower bridge .

6. Fabric guiding device according to claim 5, characterized in that the device comprises an upper bridge and a lower bridge and in that the device further comprises couplers which are switchable between a first position in which the upper bridge and the lower bridge are coupled to one another, as a result of which the upper bridge and the lower bridge are positionable together with the aid of said drive, and a second position in which the upper bridge and the lower bridge are decoupled from one another so that only the upper bridge or only the lower bridge is positionable with the aid of the drive.

7. Fabric guiding device according to claim 6, characterized in that the lower bridge is positionable in both the first and the second position of the couplers and in that said couplers are switchable between a first position in which the lower bridge and the upper bridge are coupled to one another, as a result of which they are positionable together, and a second position in which only the lower bridge is positionable.

8. Fabric guiding device according to claim 5, characterized in that the drive comprise hydraulic or electric actuators.

9. Fabric guiding device according to claim 5, characterized in that the drive comprise one or more screw mechanisms which are provided in order to position the upper bridge and/or the lower bridge with respect to one another or with respect to a fixed reference point in the weaving machine, and in that the drive comprises at least one electric motor which is provided in order to rotate the screw mechanisms for adjusting said bridges.

10. Fabric guiding device according to one of claim 6, characterized in that the drive comprises a first and second drive, wherein the first drive is provided at one end of the bridge which is positionable when the couplers are switched into their second position and in that the second drive is provided at the other end of said bridge.

11. Fabric guiding device according to claim 1, characterized in that the fabric guiding device comprises an upper bridge and a lower bridge and in that the device further comprises one or more position sensors (9) for determining the position of the upper bridge and the lower bridge .

12. Weaving machine provided with a fabric guiding device according to Claim 1.

13. Method for positioning a lower bridge and/or an upper bridge of a fabric guiding device of a weaving machine, wherein the fabric guiding device comprises first automatic clampers which are provided in order to release and secure the ends of the upper bridge and/or the lower bridge, in that, before positioning the lower bridge and/or the upper bridge, the clampers clamping the lower bridge and/or the upper bridge, respectively, are released and in that, when the desired position has been reached, the first clampers clamp the ends of the upper bridge and the lower bridge in order to hold these in the desired position.

14. Method according to claim 13 for positioning a lower bridge of a fabric guiding device of a weaving machine, having at least a lower bridge, wherein the fabric guiding device comprises first automatic clampers which are provided in order to clamp the ends of the lower bridge, and comprises second automatic clampers which are provided in order to secure the lower bridge between its two ends, wherein before the ends of the lower bridge are clamped with the first clampers:

a. the first and second automatic clampers, which secure the lower bridge, are released,
b. said lower bridge is moved until the desired position between the two ends is reached,
c. after which the second automatic clampers secure the lower bridge between its two ends,
d. after which the two ends of the lower bridge are then positioned further.

* * * * *